US012398882B2

(12) United States Patent
Chen

(10) Patent No.: US 12,398,882 B2
(45) Date of Patent: Aug. 26, 2025

(54) TORCH HEAD OF BLOWTORCH

(71) Applicant: Pro-Iroda Industries, Inc., Taichung (TW)

(72) Inventor: Wei-Long Chen, Taichung (TW)

(73) Assignee: PRO-IRODA INDUSTRIES, INC., Taichung (TW)

( * ) Notice: Subject to any disclaimer, the term of this patent is extended or adjusted under 35 U.S.C. 154(b) by 477 days.

(21) Appl. No.: 17/993,099

(22) Filed: Nov. 23, 2022

(65) Prior Publication Data

US 2023/0280029 A1 Sep. 7, 2023

(30) Foreign Application Priority Data

Mar. 2, 2022 (TW) ..... 111107607

(51) Int. Cl.
*F23D 14/38* (2006.01)
*F23D 14/02* (2006.01)

(52) U.S. Cl.
CPC ..... *F23D 14/38* (2013.01); *F23D 14/02* (2013.01)

(58) Field of Classification Search
CPC ..... F23D 14/02; F23D 14/38
See application file for complete search history.

(56) References Cited

U.S. PATENT DOCUMENTS 2,269,831 A * 1/1942 Senner ..... A01G 13/06 431/238
2,552,492 A * 5/1951 Nathan ..... F23R 3/12 432/223
2,720,257 A * 10/1955 Roberts ..... F23D 14/38 431/353
3,774,622 A * 11/1973 Steigerwald ..... A24C 1/00 131/193
4,990,060 A * 2/1991 Cheng-Chung ..... F04D 25/16 417/87
10,161,629 B2 12/2018 Yang
2005/0112518 A1* 5/2005 Watanabe ..... F23D 14/28 431/153
2015/0354813 A1* 12/2015 Yang ..... F23D 14/28 431/364

FOREIGN PATENT DOCUMENTS

CN 108361694 A 8/2018
JP 2010249449 A 11/2010
TW I537528 B 6/2016

* cited by examiner

*Primary Examiner* — Michael G Hoang
*Assistant Examiner* — Logan P Jones
(74) *Attorney, Agent, or Firm* — MUNCY, GEISSLER, OLDS & LOWE, P.C.

(57) ABSTRACT

A torch head includes a head body portion and a nozzle system inserted into the head body portion. The nozzle system includes a suction seat, an inner tube, and an outer tube. The suction seat includes a first outer channel extending longitudinally and at least one side channel extending radially. The first outer channel and the at least one side channel are not connected with each other. The inner and the outer tubes are connected to the second end of the suction seat. The outer tube circumferentially surrounds the inner tube. The first outer channel is opened to and communicated with the outer tube. The at least one side channel is opened to and communicated with the inner tube. The inner tube has an end opened to and communicated with the outer tube.

12 Claims, 6 Drawing Sheets

TORCH HEAD OF BLOWTORCH

BACKGROUND OF THE INVENTION

1. Field of the Invention

The present invention relates to a blowtorch and, particularly, to a torch head of the blowtorch.

2. Description of the Related Art

TW Patent No. 1537528 discloses a head of a blowtorch including a replaceable barrel. The head includes a body and a barrel. One end of the body is recessed along an axial direction to form a receiving space. The barrel is releasably connected to the body along the axial direction. The barrel includes a pipe and a limit ring. The pipe extends along the axial direction and has two opposite ends, a receiving seat at one end and a discharge head at another end. When the barrel is connected to the body, the receiving seat is located in the receiving space, the limit ring is sleeved on the outer periphery of the pipe, the limit ring has two opposite ends and includes a connecting portion at one end and an abutting portion at another end, the connecting portion is connected to the main body, and the abutting portion abuts against a side of the receiving seat opposite the body. The body includes a switch valve selectively opened and closed. When the gas switch valve is opened, gas can enter the barrel from the body. When the gas switch valve is closed, the body no longer outputs gas, but gas remained in the barrel may flow backward or the flame will flash back, resulting in a gas explosion in the barrel or the body.

The present invention is, therefore, intended to obviate or at least alleviate the problems encountered in the prior art.

SUMMARY OF THE INVENTION

According to the present invention, a torch head of a blowtorch includes a head body portion and a nozzle system. The nozzle system has a rear end and a front end opposite the rear end. The rear end is inserted into the head body portion and the front end protrudes out of the head body portion respectively. The nozzle system includes a suction seat, an inner tube, and an outer tube. The suction seat includes a first outer channel extending along a longitudinal direction of the nozzle system from a first end adjacent to the rear end to a second end adjacent to the front end. The suction seat includes at least one side channel extending from an outer periphery thereof along a radial direction of the nozzle system. The at least one side channel is not opened to and communicated with the first outer channel. The inner and the outer tubes are connected to the second end of the suction seat which is adjacent to the front end. The outer tube is disposed circumferentially around the inner tube. The inner tube is hollow and defines an inner channel. The outer tube is hollow and defines a second outer channel. The first outer channel is opened to and communicated with the second outer channel. The inner channel has a first end adjacent to the suction seat opened to and communicated with the at least one side channel. The inner channel has a second end opposite the first end opened to and communicated with the second outer channel. The first and the second outer channels are passages for mixtures of air and fuel. When the torch head produces a flame, the mixtures of air and fuel in the second outer channel are ignited, and so a negative pressure condition is created in the nozzle system, which cause air outside the torch head to be able to be sucked into the at least one side channel. The air sucked is able to be delivered to the second outer channel through the inner channel, thereby improving combustion efficiency and heating temperatures, preventing the mixtures of the air and fuel in the second outer channel from flowing in reverse direction toward the rear end, and inhibiting the flame from burning backward to the rear end, and preventing a gas explosion in the torch head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
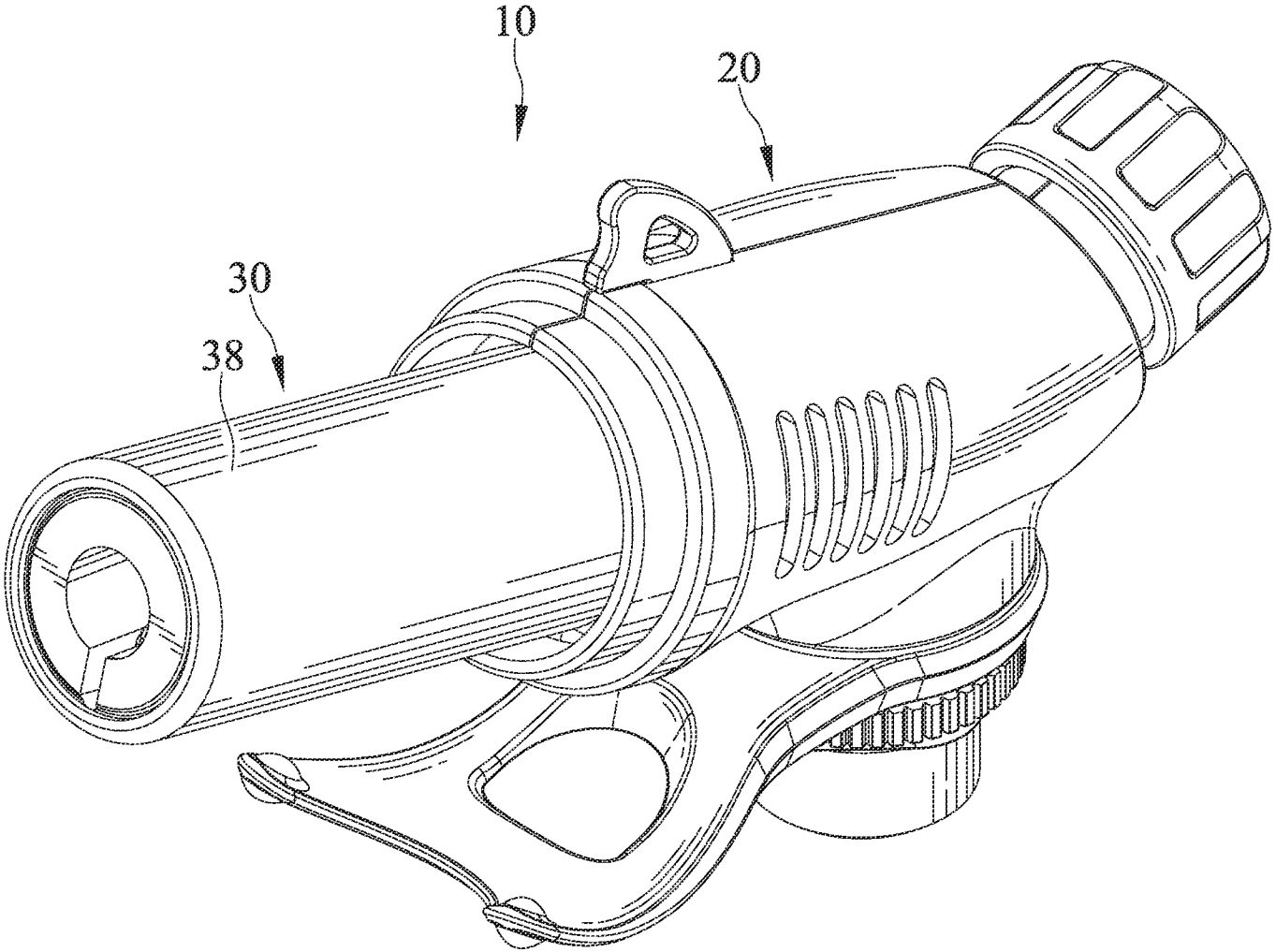
FIG. 1 is a perspective view of a torch head of a blowtorch in accordance with the present invention.
Figure 2:
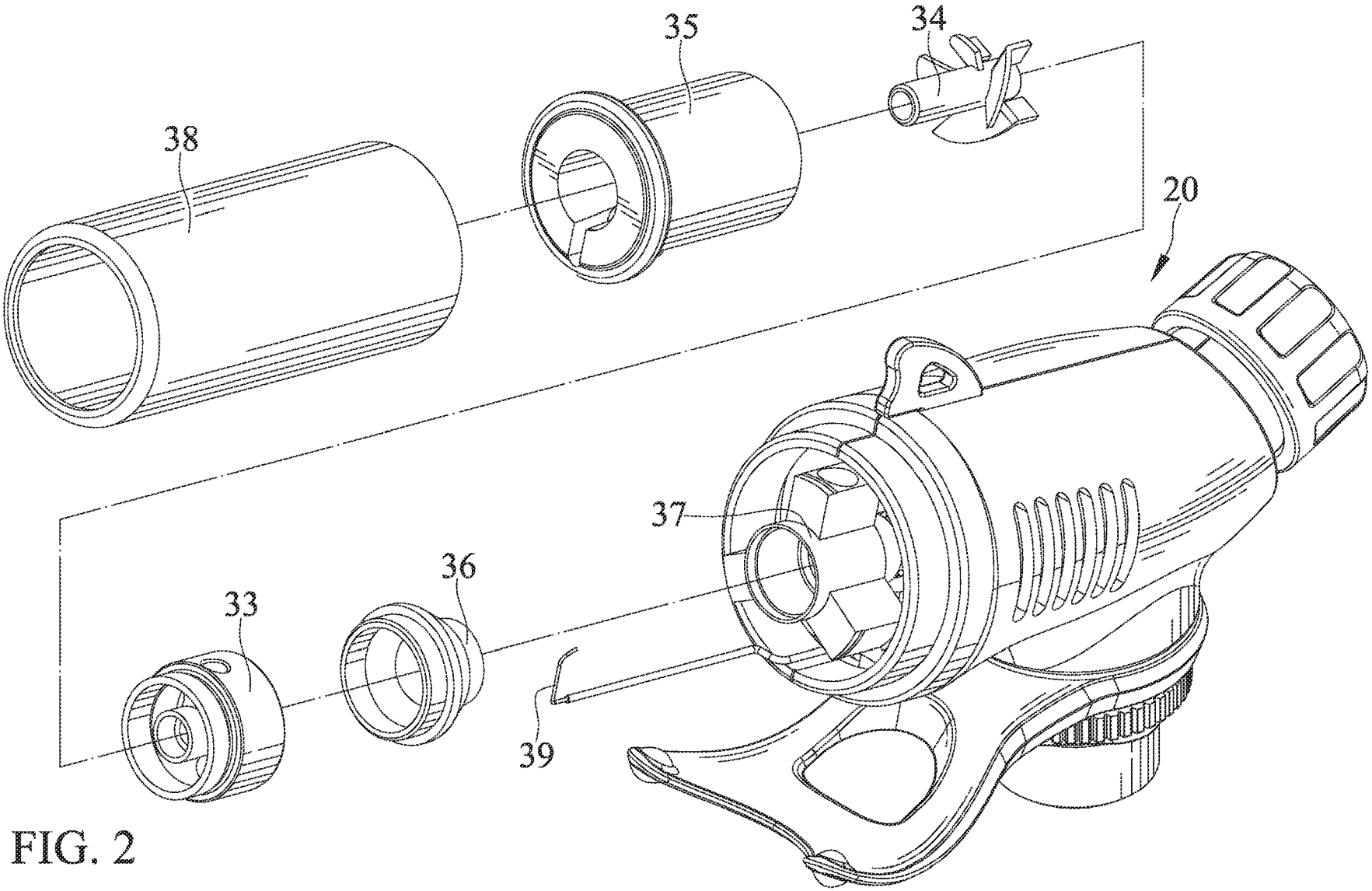
FIG. 2 is an exploded perspective view of the torch head of FIG. 1.
Figure 3:
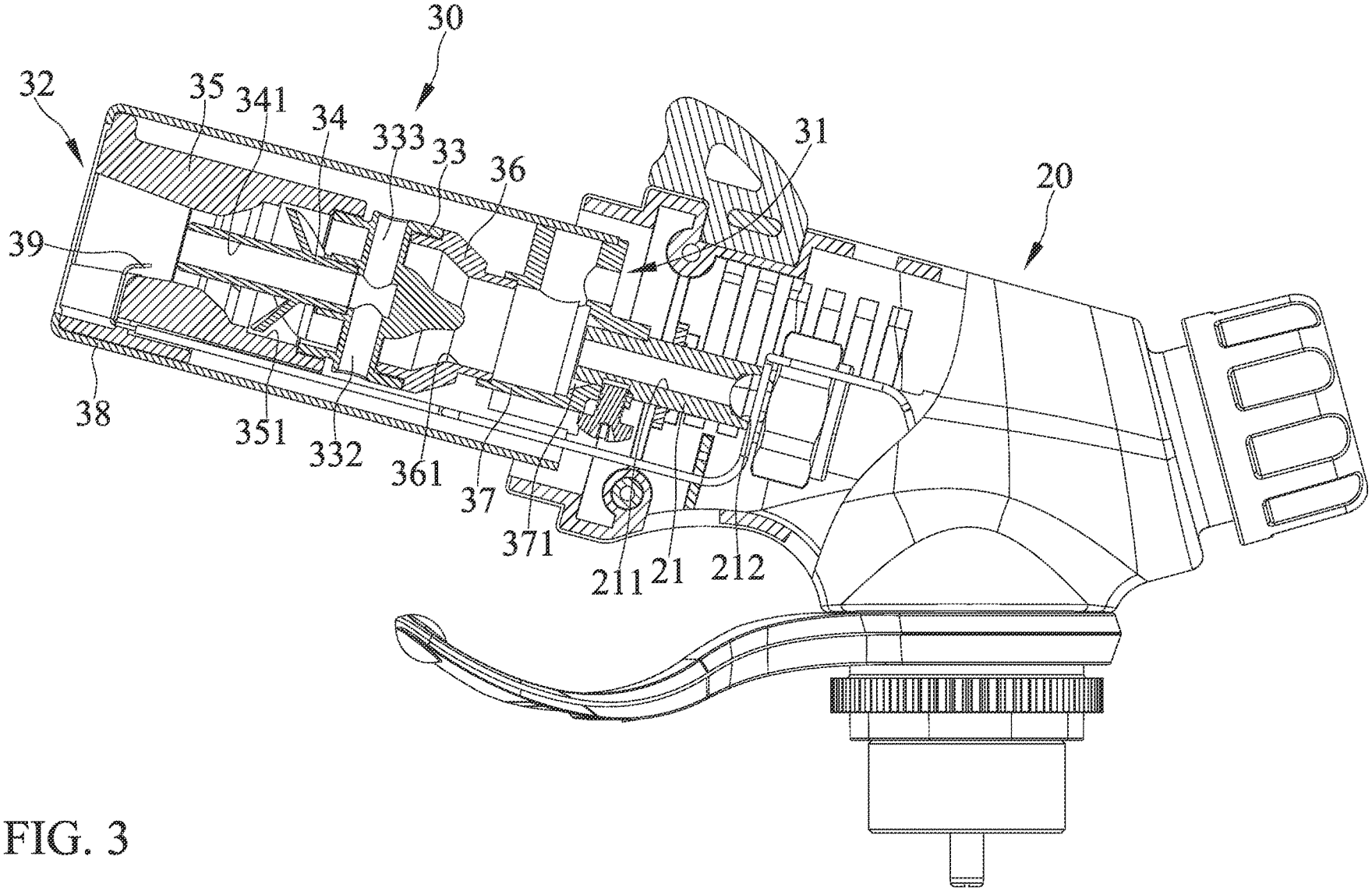
FIG. 3 is a cross-sectional view of the torch head of FIG. 1.
Figure 4:
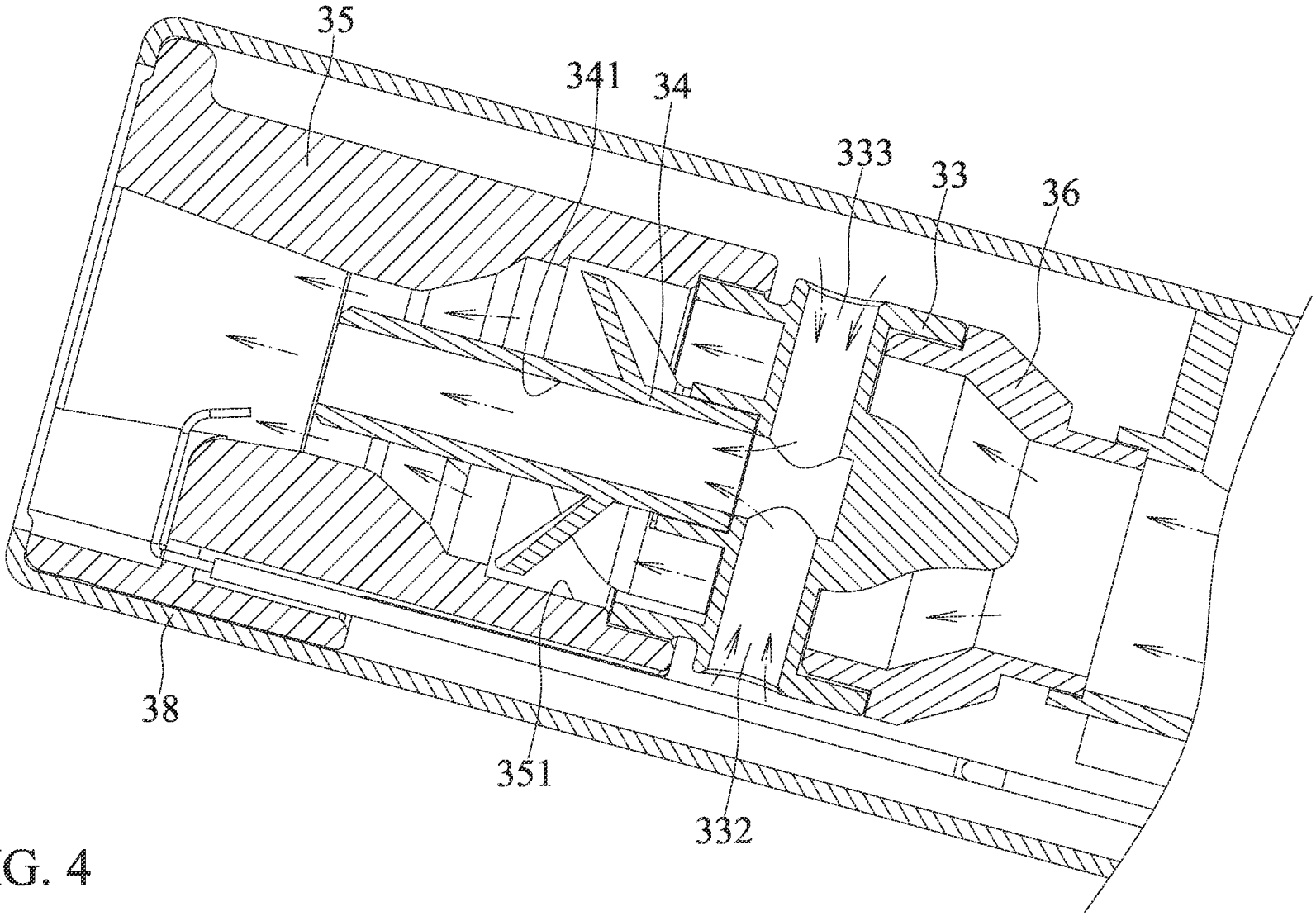
FIG. 4 is a partial enlarged view of FIG. 3 illustrating the use of the torch head of FIG. 1.
Figure 5:
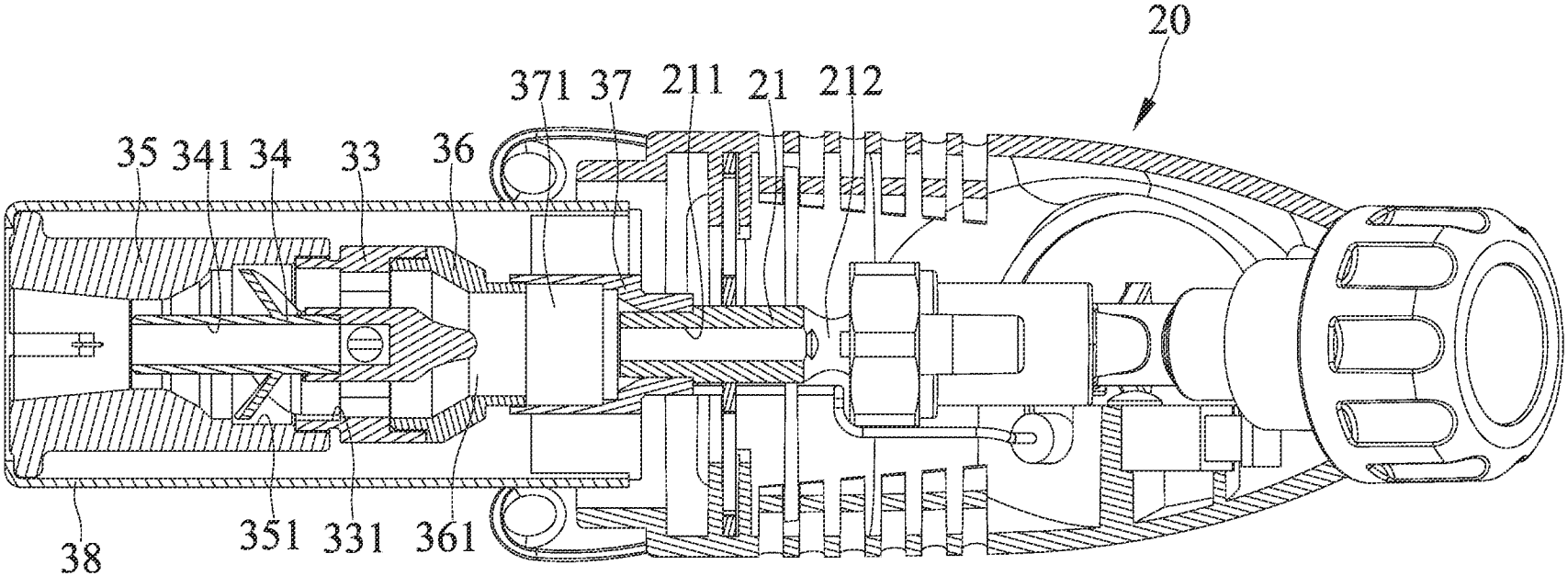
FIG. 5 is another cross-sectional view of the torch head of FIG. 1.
Figure 6:
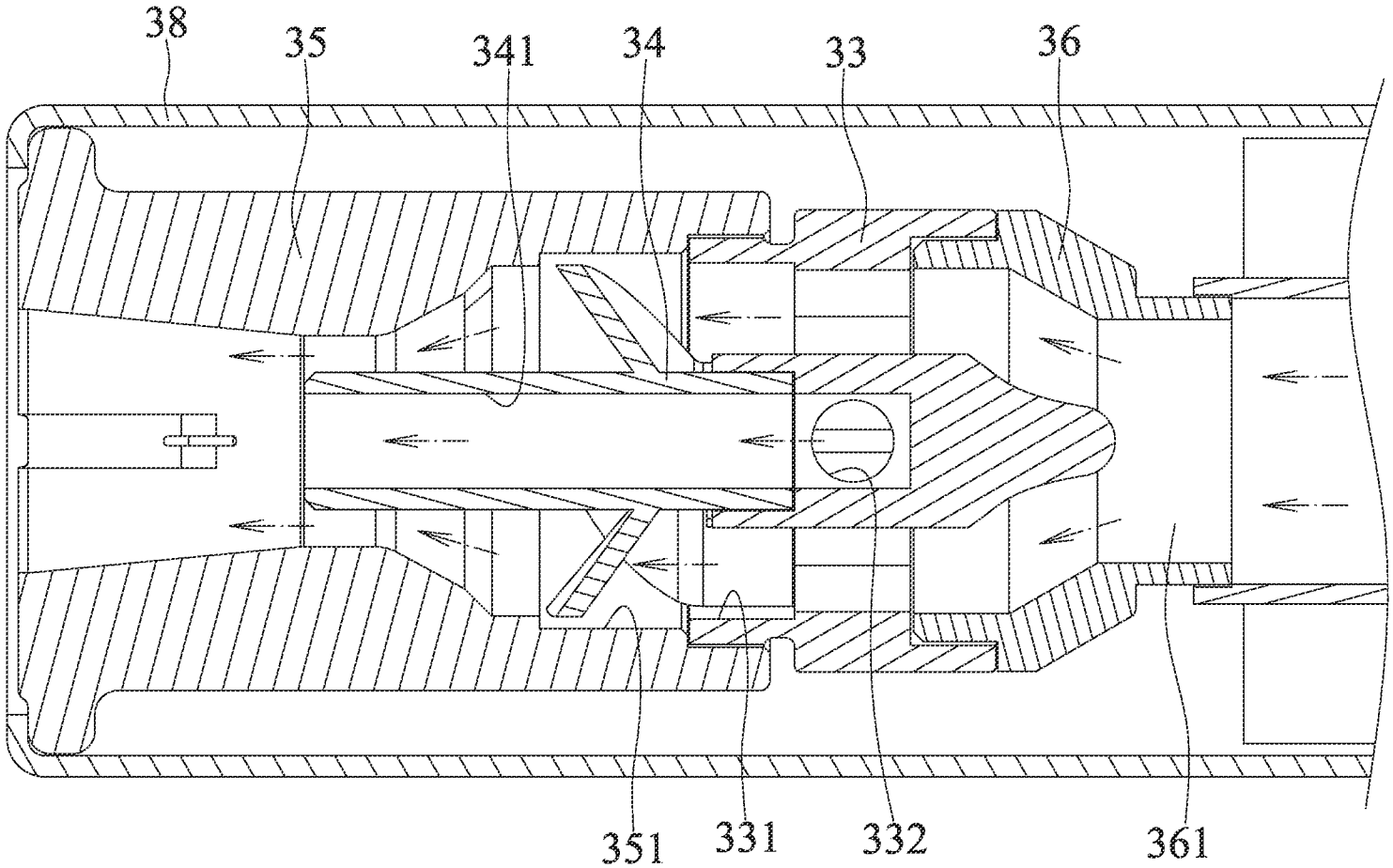
FIG. 6 is a partial enlarged view of FIG. 5 illustrating the use of the torch head of FIG. 1.

Refer to FIGS. 1 through 6, a torch head 10 of a blowtorch in accordance with the present invention includes a head body portion 20 and a nozzle system 30 disposed in the head body portion 20.

The head body portion 20 includes a mixing seat 21 therein which includes a fuel channel 211 and a mixing air channel 212 extending radially to the fuel channel 211. The fuel channel 211 is a passage for fuel. The mixing air channel 212 is a passage for air. The mixing air channel 212 is opened to and communicated with the fuel channel 211, so that fuel and air are mixed, thereby improving the combustion effect of the fuel.

The nozzle system 30 is provided with a rear end 31 and a front end 32 opposite the rear end 31. The rear end 31 is inserted into the head body portion 20 and the front end 32 protrudes out of the head body portion 20 respectively. The nozzle system 30 includes a suction seat 33, an inner tube 34, and an outer tube 35. The suction seat 33 includes a first outer channel 331 extending along a longitudinal direction of the nozzle system 30 from a first end adjacent to the rear end 31 to a second end adjacent to the front end 32. The first outer channel 331 is a passage for mixtures of air and fuel. The suction seat 33 also includes at least one side channel, i.e. a first side channel 332 and a second side channel 333, extending from an outer periphery thereof along a radial direction of the nozzle system 30. The first and the second side channels 332 and 333 are not opened to and communicated with the first outer channel 331. The first and the second side channels 332 and 333 are radially arranged. The inner and the outer tubes 34 and 35 are connected to the second end of the suction seat 33 which is adjacent to the front end 32. The outer tube 35 circumferentially surrounds the inner tube 34. The inner tube 34 is hollow and defines an inner channel 341. The inner channel 341 has a first end adjacent to the suction seat 33 opened to and communicated with the first and the second side channels 332 and 333. The inner channel has a second end opposite the first end opened to and communicated with the second outer channel 351. The outer tube 35 is hollow and defines a second outer channel 351. The second outer channel 351 is a passage for mixtures of air and fuel. The first outer channel 331 is opened to and communicated with the second outer channel 351. The second outer channel has a first end connected to the second end of the suction seat 33 and a second end being open to outside of the torch head 10.

The nozzle system 30 further includes an extension tube 36 connected to the first end of the suction seat 33 and including a third outer channel 361 opened to and communicated with the first outer channel 331. The third outer channel 361 is a passage for mixtures of air and fuel. Specifically, the third outer channel 361 has widths smaller than widths of the first outer channel 331. The widths of the first and the third outer channels 331 and 361 are measured along the radial direction of the nozzle system 30. Additionally, the widths of the third outer channel and 361 are greater than widths of the fuel channel 211. The widths of the fuel channel 211 are measured along a radial direction of the mixing seat 21.

The nozzle system 30 further includes a connecting seat 37 interconnecting the mixing seat 21 and the extension tube 36. The connecting seat 37 is includes a fourth outer channel 371 including a first end opened to and communicated with the fuel channel 211 and a second end opened to and communicated with the third outer channel 361. The fourth outer channel 371 is a passage for mixtures of air and fuel. Specifically, the fourth outer channel 371 has widths greater than widths of the fuel channel 211. The widths of the fourth outer channel 371 are measured along the radial direction of the nozzle system 30. The widths of the fuel channel 211 are measured along the radial direction of the mixing seat 21.

The nozzle 30 further includes a cover tube 38 including a first end connected to the connecting seat 37 and a second end connected to a first end of the outer tube 35 which is opposite a second end of the outer tube 35 which is connected to the second end of the suction seat 33. The cover tube 38 circumferentially surrounds the suction seat 33, the outer tube 35 and the extension tube 36. The cover tube 38 does not contact the suction seat 33 or the extension tube 36.

Further, an ignition system 39 is disposed in the head body portion 20 and protrudes into the second outer channel 351.

In view of the foregoing, when the torch head 10 produces a flame, the mixtures of air and fuel in the second outer channel 351 are ignited, and so a negative pressure condition is created in the nozzle system 30, which cause air outside the torch head 10 to be able to be sucked into the at last one side channel 332. The air sucked is able to be delivered to the second outer channel 351 through the inner channel 341, thereby improving combustion efficiency and heating temperatures, preventing the mixtures of the air and fuel in the second outer channel 351 from flowing in reverse direction toward the rear end 31, and inhibiting the flame from burning backward to the rear end 31, and preventing a gas explosion in the torch head 10.

The foregoing is merely illustrative of the principles of this invention and various modifications can be made by those skilled in the art without departing from the scope and spirit of the invention.

What is claimed is:

1. A torch head of a blowtorch comprising:

a head body portion;

a nozzle system, wherein the nozzle system has a rear end and a front end opposite the rear end, wherein the rear end is inserted into the head body portion and the front end protrudes out of the head body portion respectively, wherein the nozzle system includes a suction seat, an inner tube, and an outer tube, wherein the suction seat includes a first outer channel extending along a longitudinal direction of the nozzle system from a first end adjacent to the rear end to a second end adjacent to the front end, wherein the suction seat includes at least one side channel extending from an outer periphery thereof along a radial direction of the nozzle system, wherein the at least one side channel is not opened to and communicated with the first outer channel, wherein the inner and the outer tubes are connected to the second end of the suction seat which is adjacent to the front end, wherein the outer tube circumferentially surrounds the inner tube, wherein the inner tube is hollow and defines an inner channel, wherein the outer tube is hollow and defines a second outer channel, wherein the first outer channel is opened to and communicated with the second outer channel, wherein the inner channel has a first end adjacent to the suction seat opened to and communicated with the at least one side channel, and wherein the inner channel has a second end opposite the first end opened to and communicated with the second outer channel, wherein the first and the second outer channels are passages for mixtures of air and fuel, wherein when the torch head produces a flame, the mixtures of air and fuel in the second outer channel are ignited, and so a negative pressure condition is created in the nozzle system, which cause air outside the torch head to be able to be sucked into the at last one side channel, and wherein the air sucked is able to be delivered to the second outer channel through the inner channel, thereby improving combustion efficiency and heating temperatures, preventing the mixtures of the air and fuel in the second outer channel from flowing in reverse direction toward the rear end, and inhibiting the flame from burning backward to the rear end, and preventing a gas explosion in the torch head; and an ignition system disposed in the head body portion protrudes into the second outer channel.

2. The torch head as claimed in claim 1, wherein the head body portion includes a mixing seat therein which includes a fuel channel and a mixing air channel extending radially to the fuel channel, and wherein the mixing air channel is opened to and communicated with the fuel channel.

3. The torch head as claimed in claim 2, wherein the nozzle system includes an extension tube connected to the first end of the suction seat and including a third outer channel opened to and communicated with the first outer channel.

4. The torch head as claimed in claim 3, wherein the nozzle system includes a connecting seat interconnecting the mixing seat and the extension tube, and wherein the connecting seat includes a fourth outer channel including a first end opened to and communicated with the fuel channel and a second end opened to and communicated with the third outer channel.

5. The torch head as claimed in claim 4, wherein the nozzle system includes a cover tube including a first end connected to the connecting seat and a second end connected to a first end of the outer tube which is opposite a second end of the outer tube which is connected to the second end of the suction seat, wherein the cover tube circumferentially surrounds the suction seat, the outer tube and the extension tube, and wherein the cover tube does not contact the suction seat or the extension tube.

6. The torch head as claimed in claim 1, wherein the at least one side channel includes a first side channel and a second side channel extending from the outer periphery thereof along the radial direction of the nozzle system, and wherein the first and the second side channels are radially arranged.

7. The torch head as claimed in claim 4, wherein the third and the fourth outer channels have widths greater than widths of the fuel channel, wherein the widths of the third and the fourth outer channels are measured along the radial direction of the nozzle system, and wherein widths of the fuel channel are measured along a radial direction of the mixing seat.

8. The torch head as claimed in claim 7, wherein the widths of the third outer channel are smaller than widths of the first outer channel, and wherein the widths of the first and the third outer channels are measured along the radial direction of the nozzle system.

9. The torch head as claimed in claim 1, wherein the second outer channel has a first end connected to the second end of the suction seat and a second end being open to outside of the torch head.

10. The torch head as claimed in claim 5, wherein the at least one side channel includes a first side channel and a second side channel extending from the outer periphery thereof along the radial direction of the nozzle system, and wherein the first and the second side channels are radially arranged.

11. The torch head as claimed in claim 5, wherein the second outer channel has a first end connected to the second end of the suction seat and a second end being open to outside of the torch head.

12. The torch head as claimed in claim 11, wherein the at least one side channel includes a first side channel and a second side channel extending from the outer periphery thereof along the radial direction of the nozzle system, and wherein the first and the second side channels are radially arranged.

* * * * *